US006390517B1

(12) United States Patent
Ehret

(10) Patent No.: US 6,390,517 B1
(45) Date of Patent: May 21, 2002

(54) OPENING AID FOR DOOR LOCKS

(75) Inventor: Jürgen Ehret, Weinheim (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/676,479

(22) Filed: Oct. 4, 2000

(30) Foreign Application Priority Data

Oct. 6, 1999 (DE) ..... 199 48 052

(51) Int. Cl.[7] ..... E05C 3/06

(52) U.S. Cl. ..... 292/201; 292/216; 292/DIG. 23; 292/DIG. 42; 292/DIG. 43

(58) Field of Search ..... 292/201, 216, 292/DIG. 23, DIG. 42, DIG. 43

(56) References Cited

U.S. PATENT DOCUMENTS

| | | | | |
|---|---|---|---|---|
| 5,603,537 | A | * 2/1997 | Amano et al. | 292/201 |
| 5,697,237 | A | * 12/1997 | Dilger et al. | 70/264 |
| 5,934,717 | A | * 8/1999 | Wirths et al. | 292/201 |
| 5,938,253 | A | * 8/1999 | Szablewski et al. | 292/216 |
| 6,000,257 | A | * 12/1999 | Thomas | 70/279.1 |
| 6,076,868 | A | * 1/2000 | Roger, Jr. et al. | 292/201 |
| 6,148,651 | A | * 11/2000 | Roncin | 70/264 |
| 2001/0010427 | A1 | * 8/2001 | Roos | 292/201 |

FOREIGN PATENT DOCUMENTS

| | | |
|---|---|---|
| DE | 3319354 | 12/1983 |
| DE | 3932268 | 6/1990 |
| DE | 19505779 | 8/1996 |
| DE | 19614122 | 10/1997 |
| DE | 19614123 | 10/1997 |
| DE | 19702420 | 7/1998 |
| DE | 29813797 | 12/1998 |
| DE | 19725416 | 1/1999 |
| DE | 19742798 | 1/1999 |
| DE | 19754216 | 3/1999 |
| DE | 19747211 | 5/1999 |
| DE | 19755695 | 6/1999 |

OTHER PUBLICATIONS

Patent Abstracts of Japan JP 08013880 A Jan. 16, 1996.

* cited by examiner

*Primary Examiner*—Anthony Knight
*Assistant Examiner*—Matthew E. Rodgers
(74) *Attorney, Agent, or Firm*—Martin A. Farber

(57) ABSTRACT

A door lock (10) having an opening aid (26) has a rotatable lock latch (12), a detent pawl (18) arresting the latter in the latching position, and a driven driving pin (44) which opens the detent pawl (18) and can be blocked against a stop (50). The previously customary solution of providing the stop (50) on the detent pawl (18) restricts the structural design. In order to obtain more scope in the arrangement of the parts, it is proposed to arrange the stop (50) on a separate blocking lever (48) which can be carried along into its blocking position by the detent pawl (18) during the opening.

16 Claims, 3 Drawing Sheets

OPENING AID FOR DOOR LOCKS

FIELD AND BACKGROUND OF THE INVENTION

The invention is concerned with a door lock, in particular for doors, tailgates or hoods of motor vehicles, having a lock latch which can be pivoted between a position releasing a locking peg and a position locking the latter, a detent pawl which can be moved between a locking position arresting the lock latch and a position releasing the lock latch, and a motor-driven, circulating driving pin which, when the drive is switched on, carries the detent pawl along in its path into its position releasing the lock latch and then runs against a stop which retains the detent pawl, which is situated in its position releasing the lock latch, in a position which blocks the driving pin.

A door lock of this type, as is described, for example; in DE 195 05 779 Al, offers the possibility of switching off the electric driving motor, after the lock latch is released, by monitoring the current consumption of the motor if the driving pin runs against the stop and the current consumption rises as a consequence of the blocked motor. An electronically monitored switching-off means of this type operates more reliably than microswitches which are susceptible to faults.

In the case of the door lock described in DE 195 05 779 Al, the stop is provided directly on the detent pawl. Although this solution manages with relatively few parts, there are, limitations in this design, in the spatial arrangement which, under some circumstances, make adaptation to a predetermined constructional space more difficult.

SUMMARY OF THE INVENTION

The object of the invention is to provide a door lock having an opening aid, said lock permitting a more flexible spatial design.

According to the invention, the object is achieved by a door lock of the type described at the beginning, in which the stop is arranged on a blocking lever which is mounted separately from the detent pawl and can be carried along into its blocking position by the detent pawl as it is being shifted into the position releasing the lock latch.

The solution according to the invention offers the advantage that a more flexible spatial arrangement of the individual components is possible on account of the separately mounted blocking lever and the simplified detent pawl. As a result, adaptation of the door lock to particular spatial conditions and limitations in constructional space, as can frequently be encountered precisely in the automobile sector, is considerably simplified. In addition, there is the possibility, by varying the center of pressure, of providing a transmission ratio between the detent pawl and the blocking lever which can be used to influence the interaction between the blocking lever, the running-on driving pin and the detent pawl in order to reduce the forces which occur.

In a preferred embodiment of the invention, provision is made for the driving motor to drive a driving element which can be rotated counter to the force of a spring in a certain angular range relative to a driving disk which is arranged on the same rotational axis and on which the driving pin is arranged eccentrically.

The relative rotatability between the driving element and driving disk counter to the action of the spring avoids under all circumstances, when the electric driving motor has a defect, blocking of the detent pawl which could result in the affected lock no longer being able to open or no longer being able to close. Depending on the position in which the driving pin stops, it is moved by the prestressed spring into a position in which the detent pawl can be moved freely, or in the case of manual emergency opening, for example, the detent pawl can press aside the driving pin, lying in the way, counter to the force of the spring.

In a further, preferred refinement, provision is made for a compression spring to be arranged in a spring channel, which is open on one side, on the driving element or the driving disk and to be supported against a stop on the respective other component. Such an arrangement of the compression spring can be fitted easily, particularly low manufacturing costs arising if the driving element and the driving disk are manufactured from plastic and the spring channel and the stop are formed integrally on the respective component. Under some circumstances, the driving pin may also be manufactured from plastic, but at higher loads a driving pin made of metal or a pin which is provided with a metal coating in the region of the contact surface with the detent pawl and the stop is advantageous. Prestressing of the spring may be expedient, also for improving the grip of the spring in the spring channel.

Furthermore, a second stop is preferably provided which interacts with the rear wall of the spring channel and limits the relative rotatability between the driving element and the driving disk counter to the prestressing direction of the compression spring. This second stop ensures that undefined relative positions which might be disadvantageous for the functioning are unable to occur between the driving element and the driving disk.

It has proven expedient for the spring channel, in a simple design, to extend over an angular range of approximately 90° and to be limited by two lateral, circular-arc-shaped walls. The angular range of 90° of the extent of the spring channel allows prestressing of the compression spring situated in it by approximately 45°, an angular range which has proven particularly expedient in order to avoid malfunctions.

In order to improve the functioning capability of the door lock, it is of advantage for the lock latch to be prestressed by a spring in the direction of its open position and/or for the detent pawl to be prestressed by a spring in the direction of its position arresting the lock latch. While the lock latch can be moved during the closing of the tailgate of the vehicle, for example, into its closed position counter to the force of the restoring spring by the locking peg, the detent pawl is moved counter to the force of its restoring spring into its position releasing the lock latch. In the closed position of the lock latch, the latter is supported against a latching means on the detent pawl under the load of its prestressed spring, while when the lock latch is opened, the detent pawl is supported against a correspondingly shaped stop on the lock latch.

A particularly simple embodiment makes provision for a single spring between the lock latch and the detent pawl to prestress both elements.

BRIEF DESCRIPTION OF THE DRAWING

In the following, an exemplary embodiment of the invention is explored in greater detail with reference to the attache the figures of the drawings, in which.

DETAILED DESCRIPTION OF THE PREFERRED EMBODIMENT

Figure 1:
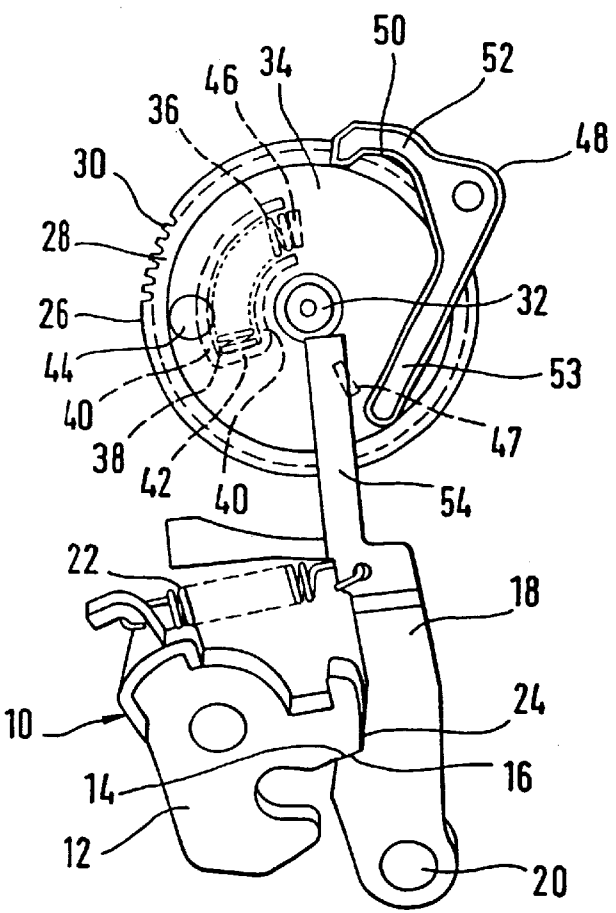
FIG. 1 shows a schematic functional diagram of a door lock in the closed inoperative position.

FIG. 1 schematically illustrates a door lock 10 as is used, for example in the motor-vehicle sector, for doors, tailgates or hoods. The door lock 10 has a lock latch 12 which is designed as a rotary latch and arrests a locking peg (not shown), which is arranged on the bodywork, in its closed position. In this arrested position, the lock latch 12 is latched with a latching lug 14 against a catch 16 on a detent pawl 18 which is mounted pivotably about a rotational axis 20. Provided between the lock latch 12 and the detent pawl 18 is a prestressed tension spring 22 which prestresses the lock latch 12, in the direction of its open position, against the catch 16 and prestresses the detent pawl 18 against a pressure flank 24 on the lock latch 12 in order to assist the arresting of the lock latch 12. The detent pawl 18 and the lock latch 12 are illustrated in a simplified manner, by leaving out, for example, a possible prelatching position between the lock latch 12 and the detent pawl 18, for the purpose of improving clarity.

In order to be able to open the lock automatically, the door lock 10 furthermore has an opening aid 26. This has a driving element 28 which is driven by an electric driving motor (101) which engages, for example via a worm 100, in an external toothing 30, which is formed as a worm wheel, on the driving element 28. The driving element is mounted rotatably about a rotational axis 32 on which a driving disk 34 is furthermore mounted rotatably. The driving disk 34 can be rotated relative to the driving element 28, the relative rotation between these two elements taking place counter to the force of a compression spring 36.

The compression spring 36 is arranged in a spring channel 38 which is open on one side and, as regards the viewing direction of FIG. 1, is formed on the lower side of the driving disk 34. The spring channel 38 extends over an angular range of approximately 90° and is formed by two lateral quarter-circle-shaped walls 40 and a rear wall 42.

Furthermore, a driving pin 44 is provided on the driving disk 34, said pin transmitting the opening forces to the detent pawl 18, which will be examined further later on.

The driving element 28 acts on the free end of the compression spring 36 via a spring stop 46, as a result of which the required torques can be transmitted to the driving disk 34. A second stop 47 on the driving element 28 limits the relative rotatability between the driving element 28 and the driving disk 34 counter to the driving direction so as to avoid undefined relative positions between these two elements.

The door lock 10 furthermore has a pivotably mounted blocking lever 48 which has a stop 50 on a first lever arm 52 and a second lever arm 53 which interacts with the detent pawl 18.

As already mentioned, the door lock 10 according to FIG. 1 is in the locked inoperative position, the driving pin 44 lying outside the engagement region of the detent pawl 18 and the blocking lever 48. The compression spring 36 is relaxed to the maximum, although it may be in a prestressed state.

Figure 2:
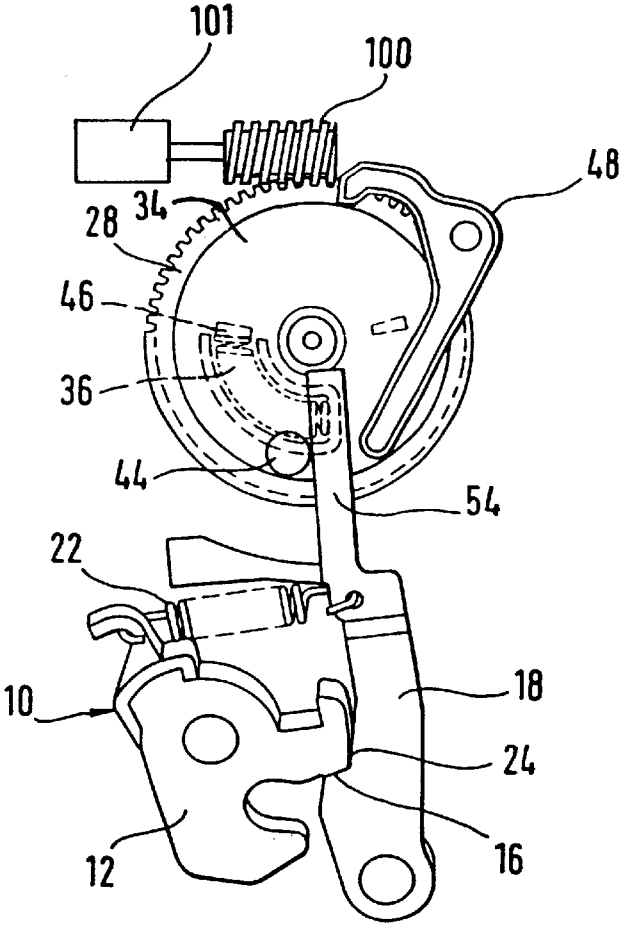
FIG. 2 shows the door lock according to FIG. 1 at the beginning of the opening procedure.
Figure 3:
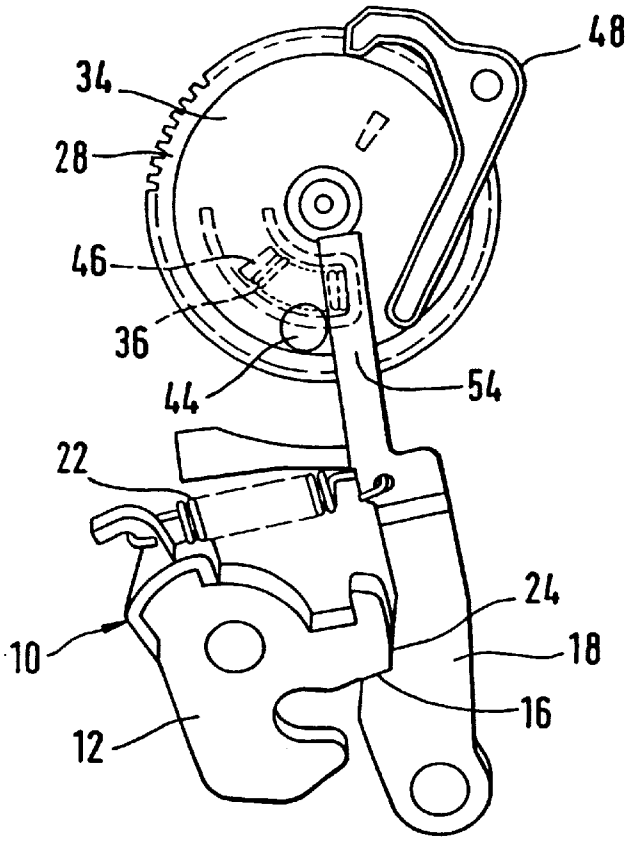
FIG. 3 shows the door lock according to FIG. 1 with the opening procedure in progress.

If the electric driving motor is now switched on, the rotating driving element 28 carries along the driving disk 34 via the spring stop 46. Since said driving disk initially runs without resistance, the compression spring 36 is initially not compressed until the driving pin 44 reaches a lever arm 54 of the detent pawl 18, in accordance with the illustration according to FIG. 2. Since the tension spring 22 is under prestressing, the more weakly dimensioned compression spring 36 is initially compressed in the spring channel 38 (see FIG. 3), since the driving element 28 is rotated further in spite of the driving disk 34 being blocked by the lever arm 54. If the spring 36 is prestressed to the maximum, the driving disk 34 is again carried along, in which case the detent pawl 18 moves, under further prestressing of the tension spring 22, outward into its position releasing the lock latch 12 (see FIG. 4).

As soon as the catch 16 releases the latching lug 14 of the lock latch 12, the latter snaps under the action of the tension spring 22 into its open position in which it releases the locking peg. The door, hood or tailgate can be opened. In this case, the detent pawl 18 is supported in the open state against the pressure flank 24 of the lock latch 12, resulting in a stable opening state in spite of the more powerfully prestressed tension spring 22.

Figure 4:
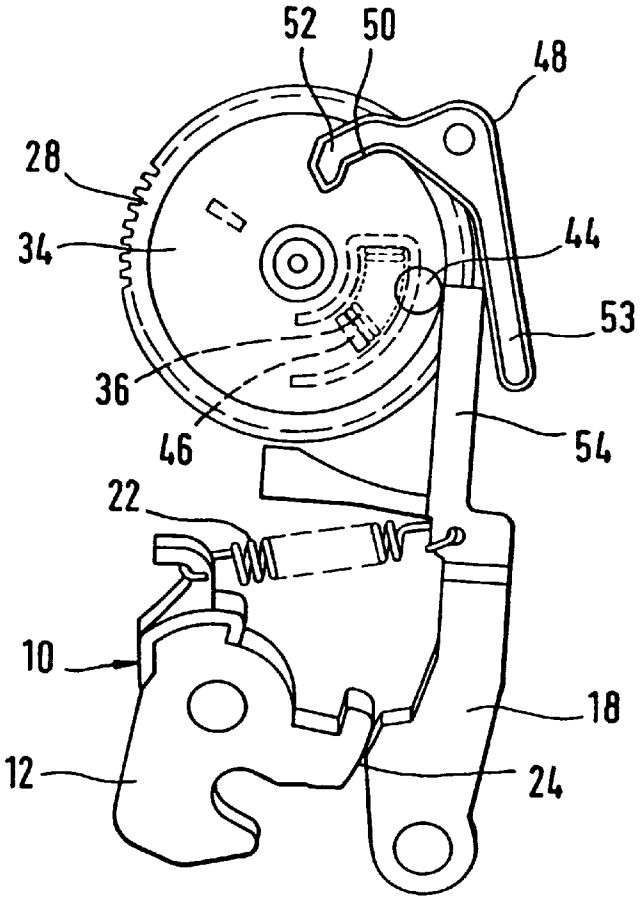
FIG. 4 shows the door lock shortly after the release of the lock latch.
Figure 6:
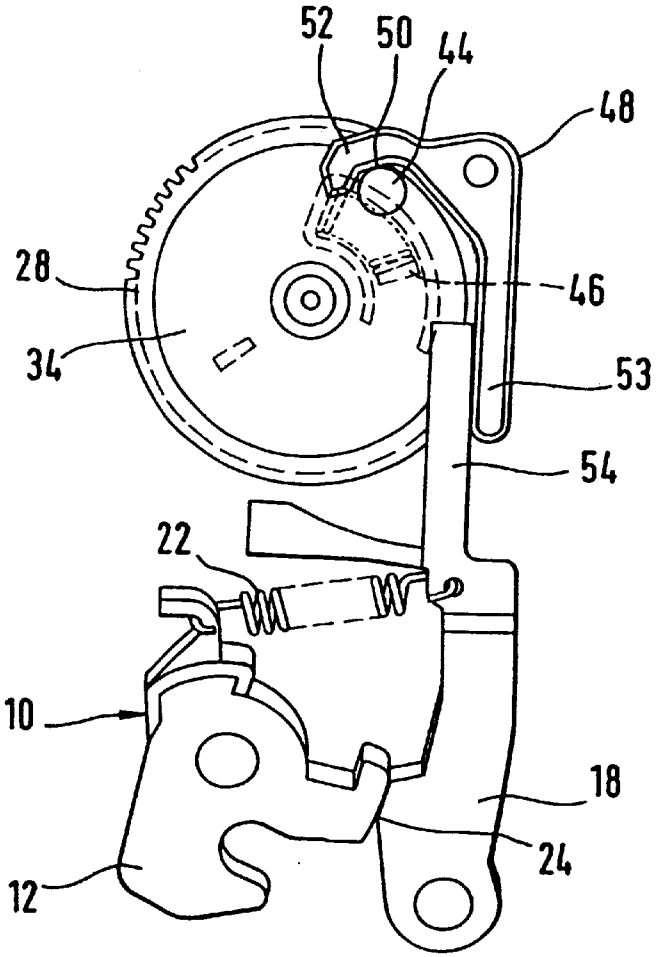
FIG. 6 shows the door lock according to FIG. 1 in the open inoperative position.
Figure 5:
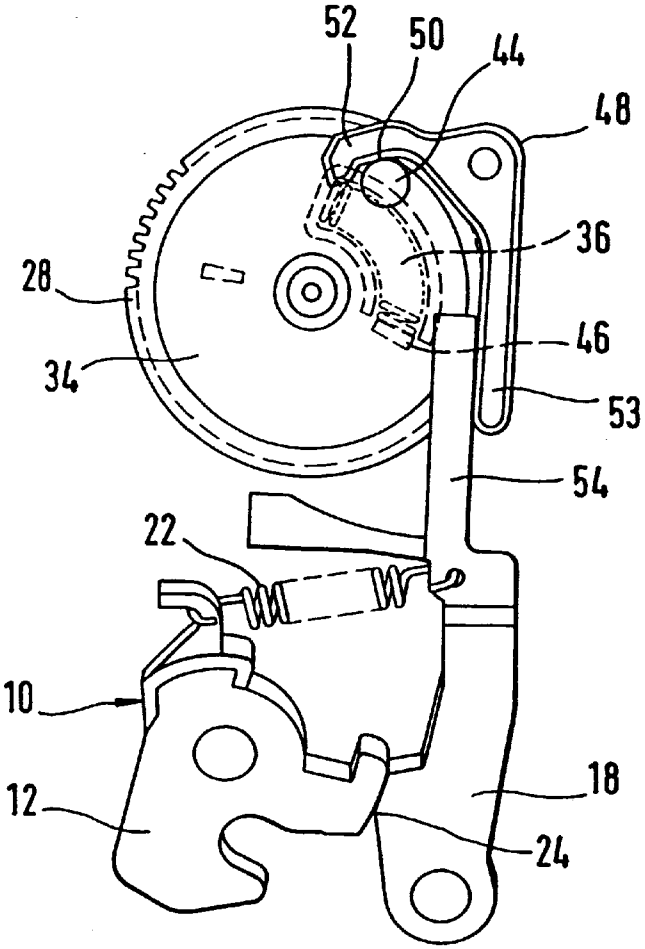
FIG. 5 shows the door lock according to FIG. 1 after the opening procedure is finished and before the drive is switched off.

Since the electric driving motor is still activated, the driving pin 44 moves beyond the position shown in FIG. 4, the compression spring 36 being immediately relaxed if the driving pin 44 has passed out of the engagement region of the lever arm 54 (see FIG. 5). The lever arm 18 of the opened detent pawl 18 also carries along the second lever arm 53 of the blocking lever 48, as a result of which the first lever arm 52, with the stops 50, is pivoted into the circulating path of the driving pin. With the compression spring 36 initially relaxed (see FIG. 5), in spite of the driving pin 44 having already been blocked by the stop 50, the driving element continues to run, with compression of the compression spring 36 over an angular range of approximately 45° until it is also blocked after exhausting the spring travel. The blocking causes a rise in the current consumption of the electric driving motor, which rise is detected electronically and causes the switching-off of the driving motor. The door lock is now situated in the open inoperative position, shown in FIG. 6, in which the tension spring 22 and the compression spring 36 are prestressed to the maximum.

If the corresponding door, hood or tailgate is now closed, the lock latch 12 is moved by the locking peg into the closed position shown in FIG. 1, the latching lug 14 again latching in the catch 16 of the detent pawl 18. The lever arm 54 thereby releases the locking lever 48 which moves clockwise, in the sense of the illustration, under the action of the compression spring 36 until the driving pin 44 is released. The driving disk 34 now moves counterclockwise, in the sense of the illustration, under the action of the relaxing compression spring 36, with the result that the door lock 10 again assumes a closed inoperative position.

The relative mobility between the driving disk 34 and the driving element 28 ensures that even in the event of the electric driving motor breaking down, the driving pin 44 cannot block the lever arm 54 of the detent pawl 18 or the first lever arm 52 of the blocking lever 48. In the event of the driving motor failing, the relative rotational range of 45° is sufficient in order to force back the driving pin, with the aid of an emergency opening device (not illustrated), to open the lock in the clockwise direction according to the illustration, if it is situated in the region of the first lever arm 52 of the blocking lever 48. If the motor breaks down with the pin 44 positioned in the region of the lever arm 54, the force of the tension spring 22 is sufficient for closing the detent pawl 18 even counter to the force of the compression spring 36.

In addition to the emergency opening device which has already been mentioned and the prelatching position which is generally provided between the lock latch and the detent pawl, the door lock 10 can have further functions, for example an automatic pulling-tight aid for the door, which can be realized in a customary manner. Use of the door lock outside the motor-vehicle sector as well is readily conceivable.

I claim:

1. A door lock, in particular for doors, tailgates or hoods of motor vehicles, having a lock latch (12) which is pivotable between a position releasing a locking peg and a position locking the latter, a detent pawl (18) which is moveable between a locking position arresting the lock latch (12) and a position releasing the lock latch (12), and a motor-driven, circulating driving pin which, when drive is switched on, carries the detent pawl (18, 54) along in its path into its position releasing the lock latch (12) and then runs against a stop (50) which retains the detent pawl (18), which is situated in its position releasing the lock latch (12), in a position which blocks the driving pin (44), wherein the stop (50) is arranged on a blocking lever (48) which is mounted separately from the detent pawl (18) and can be carried along into its blocking position by the detent pawl (18, 54) as it is being shifted into the position releasing the lock latch (12).

2. The door lock as claimed in claim 1, wherein a driving motor (101) drives a driving element (28) which can be rotate counter to the force of a spring (36) in a certain angular range relative to a driving disk (34) which is arranged on a same rotational axis (32) and on which the driving pin (44) is arranged eccentrically.

3. The door lock as claimed in claim 2, wherein said spring (36) is prestressed.

4. The door lock as claimed in claim 1, wherein the lock latch (12) is prestressed by a spring (22) in direction of its open position.

5. The door lock as claimed in claim 1, wherein the detent pawl (18) is prestressed by a spring (22) in direction of its position arresting the lock latch (12).

6. The door lock as claimed in claim 1 further comprising a driving disk (34) and/or a driving element (28) made of plastic.

7. The door lock as claimed in claim 3, wherein as the spring a compression spring (36) is arranged in a spring channel (38), which is open on one side, on the driving element (28) or the driving disk (34) and is supported against a stop (46) on respective other component (28, 34).

8. The door lock as claimed in claim 7, wherein another stop (47) interacts with a rear side (42) of the spring channel (38) and limits relative rotatability between the driving element (28) and the driving disk (34) counter to a prestressing direction of the compression spring (36).

9. The door lock as claimed in claim 7, wherein the spring channel (38) extends over an angular range of approximately 90° and is limited by two lateral, circular-arc-shaped walls (40).

10. The door lock as claimed in claim 5, wherein the spring channel (38) extends over an angular range of approximately 90° and is limited by two lateral, circular-arc-shaped walls (40).

11. The door lock as claimed in claim 8, wherein the spring channel (38) extends over an angular range of approximately 90° and is limited by two lateral, circular-arc-shaped walls (40).

12. The door lock as claimed in claim 2, wherein as the spring a compression spring (36) is arranged in a spring channel (38), which is open on one side, on the driving element (28) or the driving disk (34) and is supported against a stop (46) on respective other component (28, 34).

13. The door lock as claimed in claim 12, wherein another (47) interacts with a rear side (42) of the spring channel and limits relative rotatability between the driving element (28) and the driving disk (34) counter to a prestressing direction of the compression spring (36).

14. The door lock as claimed in claim 2, wherein the spring (36) is prestressable over a rotational angle of approximately 45°.

15. The door lock as claimed in claim 4, wherein the detent pawl (18) is prestressed by said spring (22) in direction of its position arresting the lock latch (12), and wherein said single spring (22) between the lock latch (12) and the detent pawl (18) simultaneously prestresss both.

16. The door lock as claimed in claim 12, wherein the spring channel (38) extends over an angular range of approximately 90° and is limited by two lateral, circular-arc-shaped walls (40).

* * * * *